US005197506A

United States Patent [19]

Morin

[11] Patent Number: 5,197,506

[45] Date of Patent: Mar. 30, 1993

[54] TENT STAKE COVER APPARATUS

[76] Inventor: Daniel B. Morin, 6 Townview Cir., E. Longmeadow, Mass. 01028

[21] Appl. No.: 772,555

[22] Filed: Oct. 7, 1991

[51] Int. Cl.[5] ..... E04H 15/62

[52] U.S. Cl. ..... 135/118; 248/500; 248/508

[58] Field of Search ..... 135/118; 248/500, 508; 40/574, 553; 114/218; 52/147

[56] References Cited

U.S. PATENT DOCUMENTS

| | | | |
|---|---|---|---|
| 2,054,988 | 9/1936 | Miller | 52/147 |
| 3,738,299 | 6/1973 | Packler . | |
| 3,814,118 | 6/1974 | Larson | 135/118 |
| 4,407,600 | 10/1983 | Thompson | 52/147 X |
| 4,432,382 | 2/1984 | Wolf . | |
| 4,905,718 | 3/1990 | Vandiver . | |
| 4,953,576 | 9/1990 | Connelly . | |

FOREIGN PATENT DOCUMENTS

| | | | |
|---|---|---|---|
| 1027588 | 5/1953 | France | 135/118 |

*Primary Examiner*—Richard E. Chilcot, Jr.
*Assistant Examiner*—Lan M. Mai
*Attorney, Agent, or Firm*—Leon Gilden

[57] ABSTRACT

A cover structure arranged for the positioning in a surrounding relationship relative to an exposed portion of a tent stake is provided includes a housing; The cover structure arranged for surrounding relationship relative to a tent stake portion preventing inadvertent injury upon accidental impact with the tent stake. A cover structure is preferably formed of a luminescent material to visually enhance its orientation during conditions of limited available light.

5 Claims, 4 Drawing Sheets

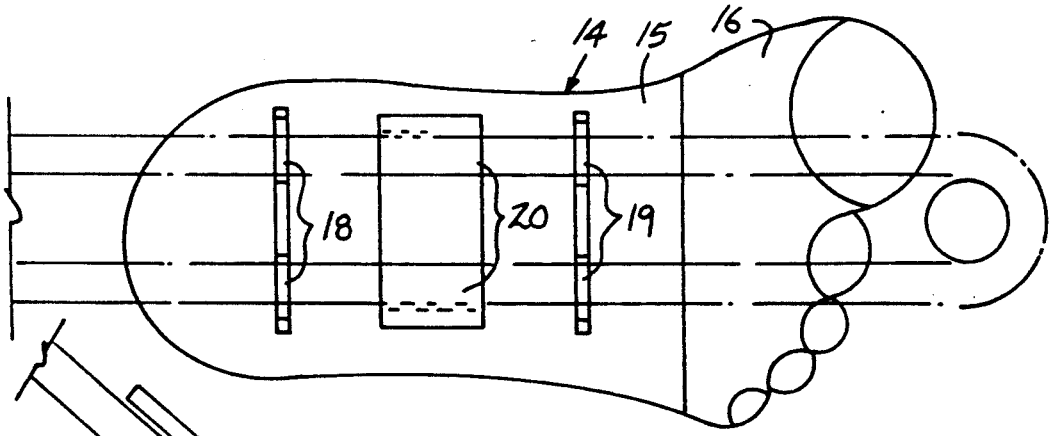
FIG 1
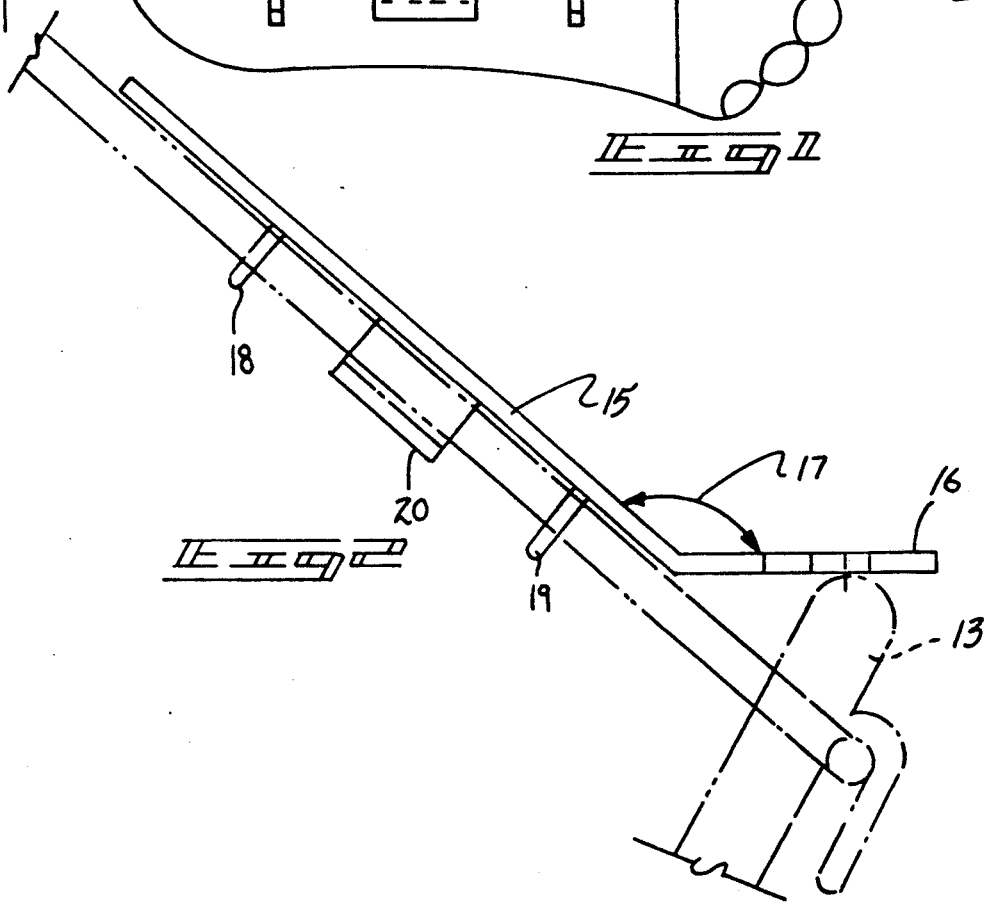
FIG 2
FIG 3
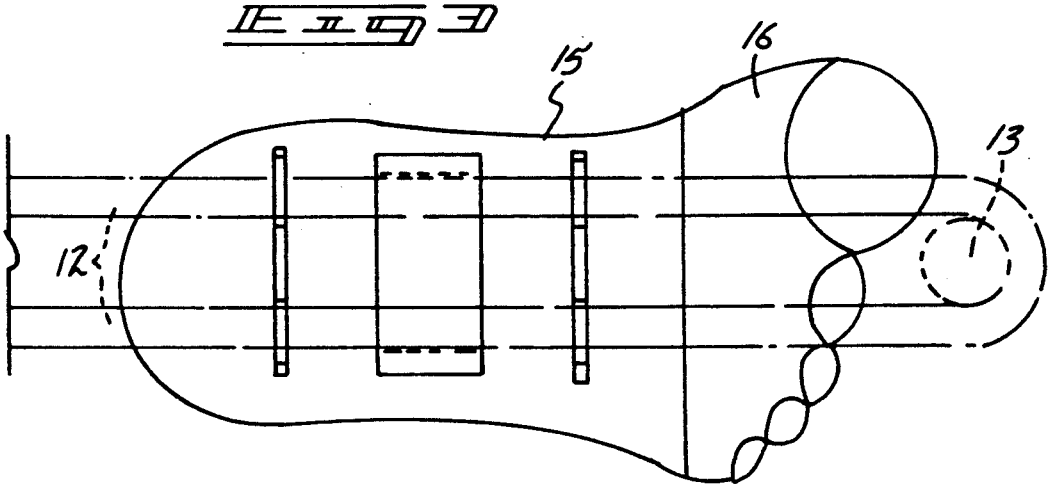

TENT STAKE COVER APPARATUS

BACKGROUND OF THE INVENTION

1. Field of the Invention

The field of invention relates to tent apparatus, and more particularly pertains to a new and improved tent stake cover apparatus wherein the same is arranged to provide for a covering housing relative to an exposed tent stake.

2. Description of the Prior Art

In the securement of tents and the like in a typical camping scenario for example, the tent is secured relative to the surrounding ground surface by a plurality of stake members directed into the ground to afford stability to the tent. During conditions of limited available light such as in the evening, exposed portions of the tent stakes provide for a dangerous projection to effect injury to an individual encountering the tent stake while walking about the erected tent structure. Such stake structure is exemplified in U.S. Pat. No. 4,905,718 to Vandiver wherein a tent stake includes a loop member arranged for securement of a tent relative to a ground surface, and similarly in U.S. Pat. Nos. 4,953,576 to Connelly and 4,432,382 to Wolf, the tent stake is arranged for exposure.

U.S. Pat. No. 3,738,299 to packler sets forth a method of forming emblems including phosphorescent material to permit them to glow in the dark.

As such, it may be appreciated that there continues to be a need for a new and improved tent stake cover apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of tent stake apparatus now present in the prior art, the present invention provides a tent stake cover apparatus wherein the same is arranged to provide for a luminescent cover structure minimizing injury to an individual during inadvertent impact with a tent stake cover. As such, the general purpose of the present invention, which will be described subsequently in greater detail, is to provide a new and improved tent stake cover apparatus which has all the advantages of the prior art tent stake apparatus and none of the disadvantages.

To attain this, the present invention provides a cover structure arranged for the positioning in a surrounding relationship relative to an exposed portion of a tent stake in a first embodiment, including a slide plate formed with a first planar section mounted obliquely to a second planar section to provide a covering for a tent stake, wherein a second embodiment includes a housing arranged for surrounding relationship relative to a tent stake portion preventing inadvertent injury upon accidental impact with the tent stake. A cover structure is preferably formed of a luminescent material to visually enhance its orientation during conditions of limited available light.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tent stake cover apparatus which has all the advantages of the prior art tent stake apparatus and none of the disadvantages.

It is another object of the present invention to provide a new and improved tent stake cover apparatus which may be easily and efficiently manufactured and marketed.

It is a further object of the present invention to provide a new and improved tent stake cover apparatus which is of a durable and reliable construction.

An even further object of the present invention is to provide a new and improved tent stake cover apparatus which is susceptible of a low cost of manufacture with regard to both materials and labor, and which accordingly is then susceptible of low prices of sale to the consuming public, thereby making such tent stake cover apparatus economically available to the buying public.

Still yet another object of the present invention is to provide a new and improved tent stake cover apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein;

FIG. 1 is a top orthographic view of a cover apparatus utilized by the invention.

FIG. 2 is an orthographic side view of the invention, as set forth in FIG. 1.

FIG. 3 is a further plan view of the cover structure.

DESCRIPTION OF THE PREFERRED EMBODIMENT

Figure 4:
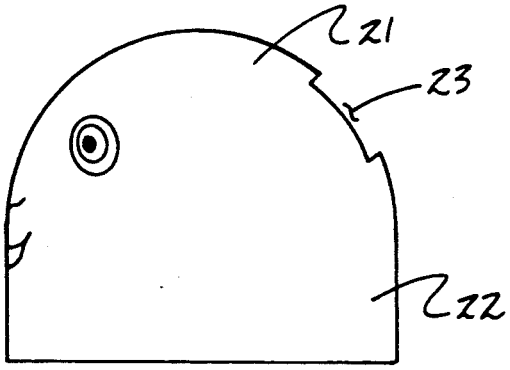
FIG. 4 is an orthographic side view of a further cover apparatus.
Figure 5:
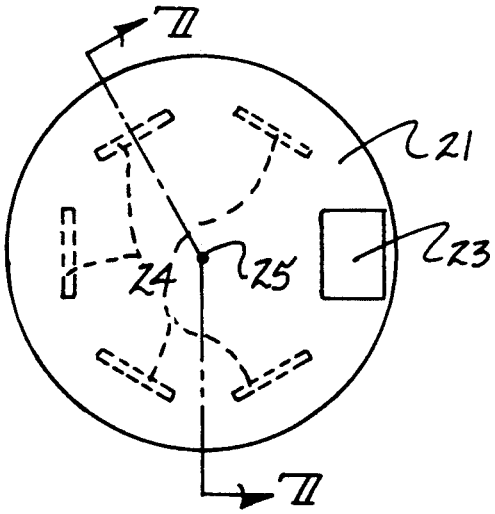
FIG. 5 is an orthographic top view of the cover structure as set forth in FIG. 4.
Figure 6:
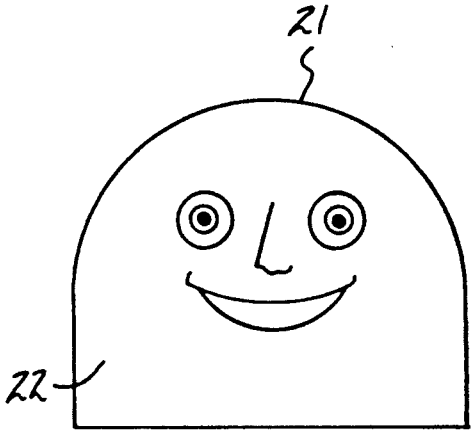
FIG. 6 is an orthographic front view of the cover structure.
Figure 7:
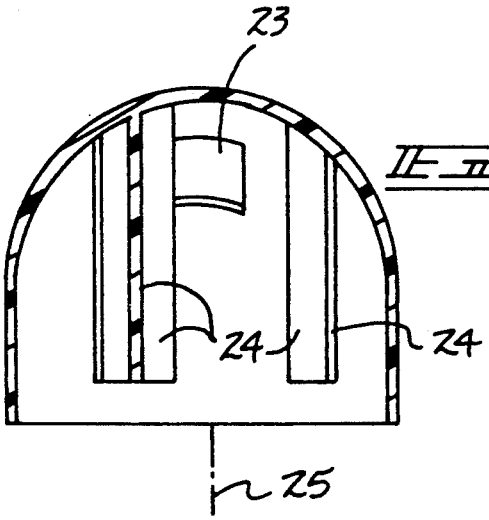
FIG. 7 is an orthographic view, taken along the lines 7—7 of FIG. 5 in the direction indicated by the arrows.

With reference now to the drawings, and in particular to FIGS. 1 to 12 thereof, a new and improved tent stake cover apparatus embodying the principles and concepts of the present invention and generally designated by the reference numerals 10 and 10*a* will be described.

Figure 8:
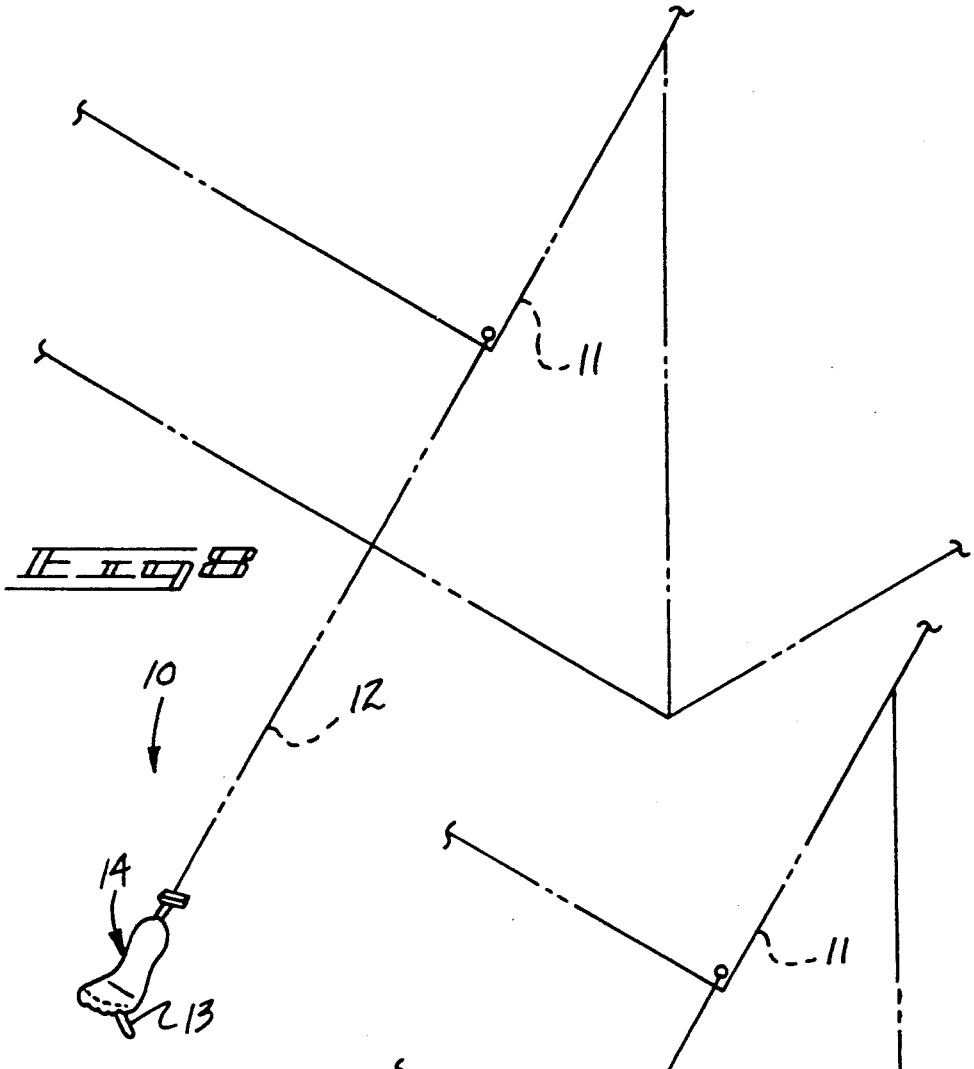
FIG. 8 is an isometric illustration of the apparatus in use.

More specifically, the tent stake cover apparatus 10 of the instant invention essentially comprises the organization, as illustrated in the FIG. 8, to include a tent housing 11, with a typical tent rope 12 directed from the tent housing 11 to a tent stake 13. A cover 14, as illustrated in the FIGS. 8 and 1 for example, provides for a sliding covering orientation relative to the rope 12. The cover 14 includes a first cover plate integrally mounted to a second cover plate 16, wherein the second cover plate and the first cover plate define an obtuse angle therebetween as the second cover plate is integrally mounted to a forward edge of the first cover plate coextensive with the forward edge and the second plate 16 is positioned to overlie the upper terminal end of the stake 13, in a manner as illustrated in FIG. 2. A plurality of rear guide loops 18 are arranged parallel to a plurality of forward guide loops 19, wherein the rear guide loops are mounted to a bottom surface of the first plate 15 and the forward guide loops 19 are mounted to a bottom surface of the second plate 16. A plurality of medial guide loops 20 are positioned between the rear and forward guide loop pairs 18 and 19 to receive the rope 12 therethrough, as illustrated in the FIGS. 1-3.

Figure 9:
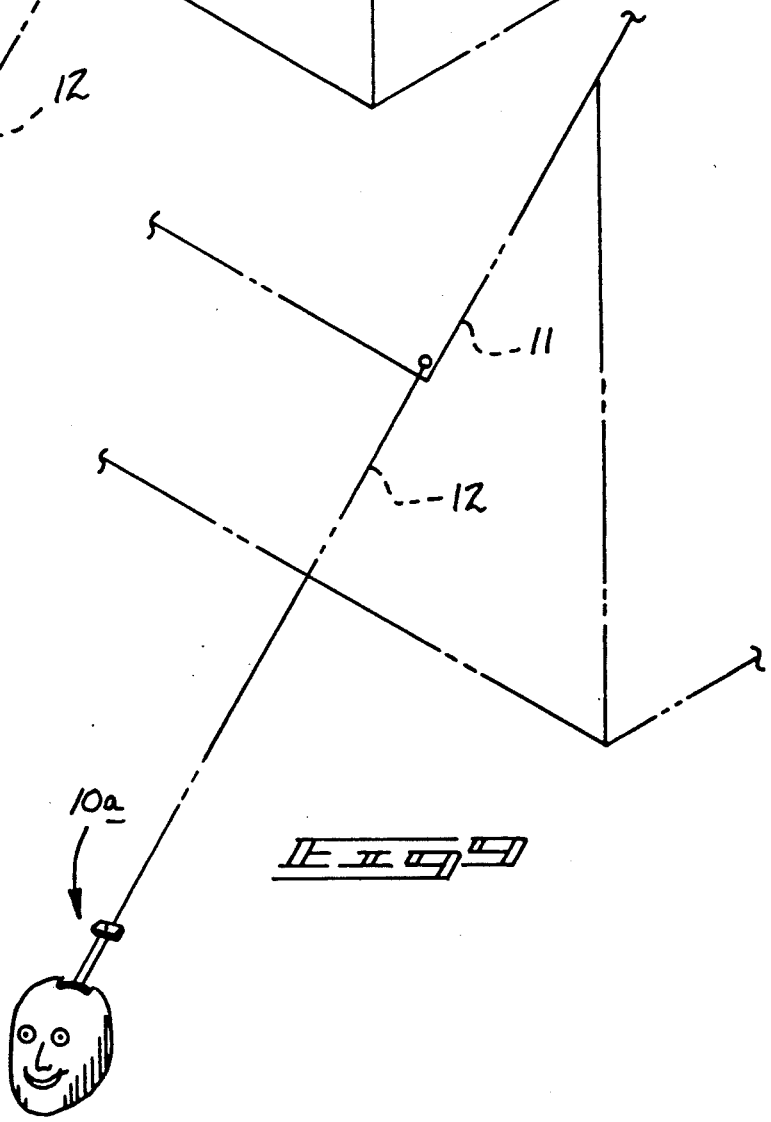
FIG. 9 is an isometric illustration of the modified apparatus in use.

A modified cover apparatus 10*a*, as depicted in FIG. 9 with reference to FIGS. 4-7, includes a hemispherical cover upper portion 21 formed to an upper terminal end of a cylindrical lower body 22, wherein the lower body 22 is defined by a first diameter, and the upper portion 21 includes a rope receiving opening 23 directed therethrough. The upper and lower body portions 21 and 22 are coaxially aligned about a cylindrical body axis 25, with a plurality of spring finger flanges 24 integrally mounted to an inner surface of the hemispherical upper portion 21 projecting downwardly therefrom and arranged parallel to the axis 25 in a spaced relationship thereto to effect clamping of the tent stake 13 projecting into the lower body 22 and the hemispherical upper portion 21 to engage and position the cover in use.

Figure 10:
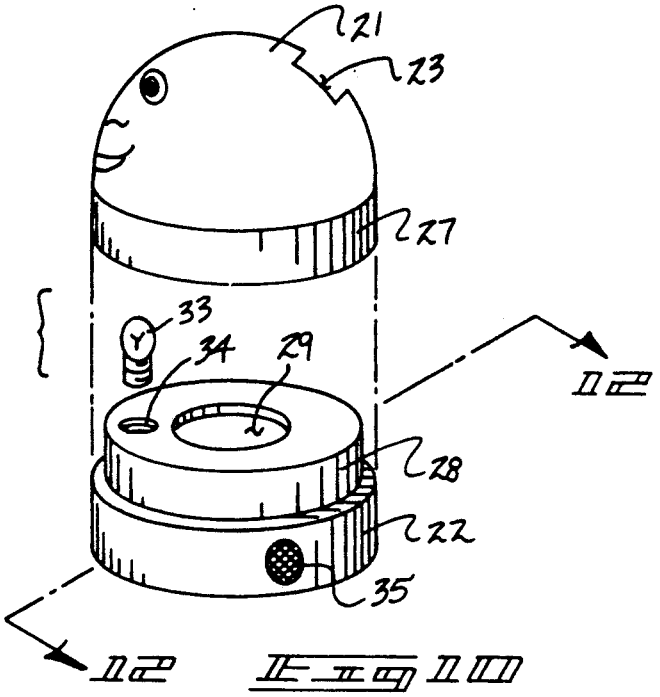
FIG. 10 is an isometric exploded view of the modified cover apparatus.
Figure 11:
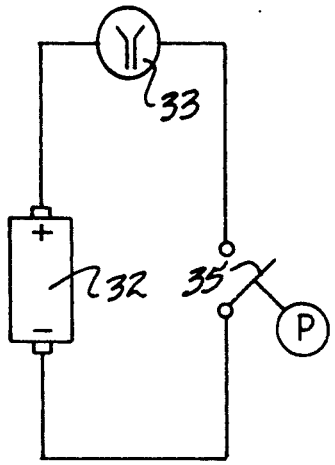
FIG. 11 is an electrical diagrammatic view of circuitry employed by the apparatus as set forth in FIG. 10.
Figure 12:
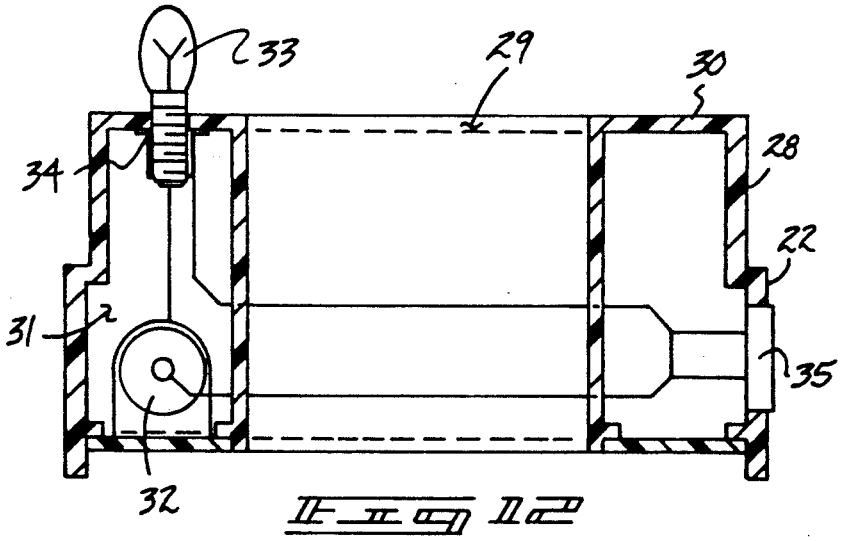
FIG. 12 is an orthographic view, taken along the lines 12—12 of FIG. 10 in the direction indicated by the arrows.

The modified apparatus 10*a* may be further formed, as illustrated in the FIGS. 10 and 12 to include the cylindrical body 22 formed with a cylindrical body extension 28 coaxially aligned with the cylindrical lower body 22 and formed with a top housing wall 30 orthogonally oriented relative to the axis 25 to include a coaxially aligned stake receiving bore 29 directed through the top housing wall 30. The hemispherical cover upper portion 21 includes a cylindrical cover skirt 27 formed with an internal diameter substantially equal to a second diameter defined by the cylindrical body extension 28 projecting upwardly relative to the cylindrical lower body 22, wherein the extension 28 is defined by a second diameter less than the first diameter to provide a smooth outer wall when the hemispherical cover upper portion 21 is secured to the cylindrical lower body 22. A battery compartment 31 is mounted within the lower body 22 to include a battery 32 therewithin. Illumination bulb 33 is directed through the top housing wall 30 coaxially spaced from the stake receiving bore 29 and in electrical communication with the battery 32 and operative to effect selective illumination thereof through photo-cell switch 35, whereupon during periods of limited available light such as in the evening hours, the illumination bulb will be actuated to provide for illumination as in preferably the hemispherical cover upper portion 21 is at least formed of a translucent and preferably of a translucent luminescent material formed of luminescent material such as a phosphorescent, such as utilized in the U.S. Pat. No. 3,738,299 incorporated herein by reference.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A tent stake cover apparatus in combination with a tent stake and a tent stake rope, wherein the apparatus includes the cover formed with a hemispherical cover upper portion, the hemispherical cover upper portion includes a rope receiving opening directed therethrough, and the upper portion further includes a cylindrical cover skirt, and a cylindrical lower body includes a coaxially aligned cylindrical body extension receiving the cylindrical cover skirt, wherein the cylindrical lower body and the hemispherical cover upper portion receive the tent stake therewithin, and the tent rope is fixedly secured to an upper terminal end of the tent stake and is directed through the rope receiving opening of the hemispherical cover upper portion wherein the hemispherical cover upper portion includes a plurality of spring finger flanges projecting downwardly relative to an interior surface of the hemispherical cover upper portion in a spaced parallel relationship relative to the cylindrical body axis for clamping of the tent stake within the spring finger flanges.

2. An apparatus as set forth in claim 1 wherein the cylindrical cover skirt complementarily receives the cylindrical body extension therewithin, and the hemispherical cover upper portion, the cylindrical body extension, and the cylindrical lower body are coaxially aligned relative to one another along a cylindrical body axis.

3. An apparatus as set forth in claim 2 wherein the cylindrical lower body includes a top housing wall orthogonally oriented relative to the cylindrical body axis, and the top housing wall is formed at an upper terminal end of the body extension, and the top housing wall includes a stake receiving bore directed therethrough coaxially aligned with the cylindrical body axis.

4. An apparatus as set forth in claim 1 wherein the cylindrical lower body includes a battery compartment, and a battery is mounted within the battery compartment, and an illumination bulb is mounted within a bulb socket, the bulb socket is directed through the top housing wall spaced from the stake receiving bore, and the illumination bulb is in electrical communication with the battery, and a photo-cell switch directed through the cylindrical lower body is in electrical communication with the battery and the illumination bulb to effect selective actuation of the illumination bulb during conditions of limited available light.

5. An apparatus as set forth in claim 1 wherein the hemispherical cover upper portion is formed of a translucent luminescent material.

* * * * *